US008251148B2

(12) United States Patent
von der Ohe

(10) Patent No.: US 8,251,148 B2
(45) Date of Patent: Aug. 28, 2012

(54) SYSTEM FOR ACTIVE HEAVE COMPENSATION AND USE THEREOF

(75) Inventor: Christian von der Ohe, Kristiansand (NO)

(73) Assignee: National Oilwell Norway AS, Kristiansand (NO)

( * ) Notice: Subject to any disclaimer, the term of this patent is extended or adjusted under 35 U.S.C. 154(b) by 609 days.

(21) Appl. No.: 12/302,170

(22) PCT Filed: May 31, 2007

(86) PCT No.: PCT/NO2007/000190

§ 371 (c)(1), (2), (4) Date: Feb. 10, 2009

(87) PCT Pub. No.: WO2007/139394

PCT Pub. Date: Dec. 6, 2007

(65) Prior Publication Data

US 2010/0050917 A1 Mar. 4, 2010

(30) Foreign Application Priority Data

Jun. 1, 2006 (NO) ..... 20062521

(51) Int. Cl.
*E21B 7/12* (2006.01)

(52) U.S. Cl. ..... 166/355

(58) Field of Classification Search ..... 166/350–355, 166/367; 60/398, 413; 138/31, 26; 114/122
See application file for complete search history.

(56) References Cited

U.S. PATENT DOCUMENTS 3,718,316 A * 2/1973 Larralde et al. ..... 254/277
3,721,293 A * 3/1973 Ahlstone et al. ..... 166/355
3,793,835 A * 2/1974 Larralde ..... 60/413
3,902,319 A * 9/1975 Olmsted ..... 60/413
3,905,580 A * 9/1975 Hooper ..... 60/413
3,912,227 A * 10/1975 Meeker et al. ..... 254/271
3,946,559 A * 3/1976 Stevenson ..... 60/413

(Continued)

FOREIGN PATENT DOCUMENTS

GB 2 053 127 A 2/1981

(Continued)

*Primary Examiner* — Thomas Beach
*Assistant Examiner* — Aaron Lembo
(74) *Attorney, Agent, or Firm* — Frommer Lawrence & Haug LLP; Ronald R. Santucci

(57) ABSTRACT

A system for active heave compensation of the running block in a drilling derrick on board a floating off shore platform comprises a double-acting hydraulic cylinder (1) which is connected to a hydraulic power unit (3) for the supply of hydraulic pressure fluid to the hydraulic cylinder (1), a control unit (6) which regulates the supply conditions of the pressure fluid to the at any time active side (A, B) of the hydraulic cylinder, the hydraulic fluid concurrently being permitted to leave the passive side (B, A) of the hydraulic cylinder. The hydraulic power unit (3) comprises a pump unit (4) which via respective conduits (9*a*, 9*b*) are directly connected to the two sides (A, B) of the hydraulic cylinder (1) in order to form a generally closed hydraulic system therewith. The hydraulic fluid delivered by the pump unit (4) to the conduits (9*a*, 9*b*) to the active cylinder side is drawn from the conduit (9*b*, 9*a*) to the passive cylinder side, while the control unit regulates the output of the pump unit. The hydraulic system further comprises an accumulator (11) which equalizes the volumetric difference between the two sides of the hydraulic cylinder when it is a common double-acting cylinder. The system may also be provided with a hydraulic transformer (23) for regeneration of hydraulic power during passive operation of the compensation system.

14 Claims, 7 Drawing Sheets

U.S. PATENT DOCUMENTS

Figure 1:
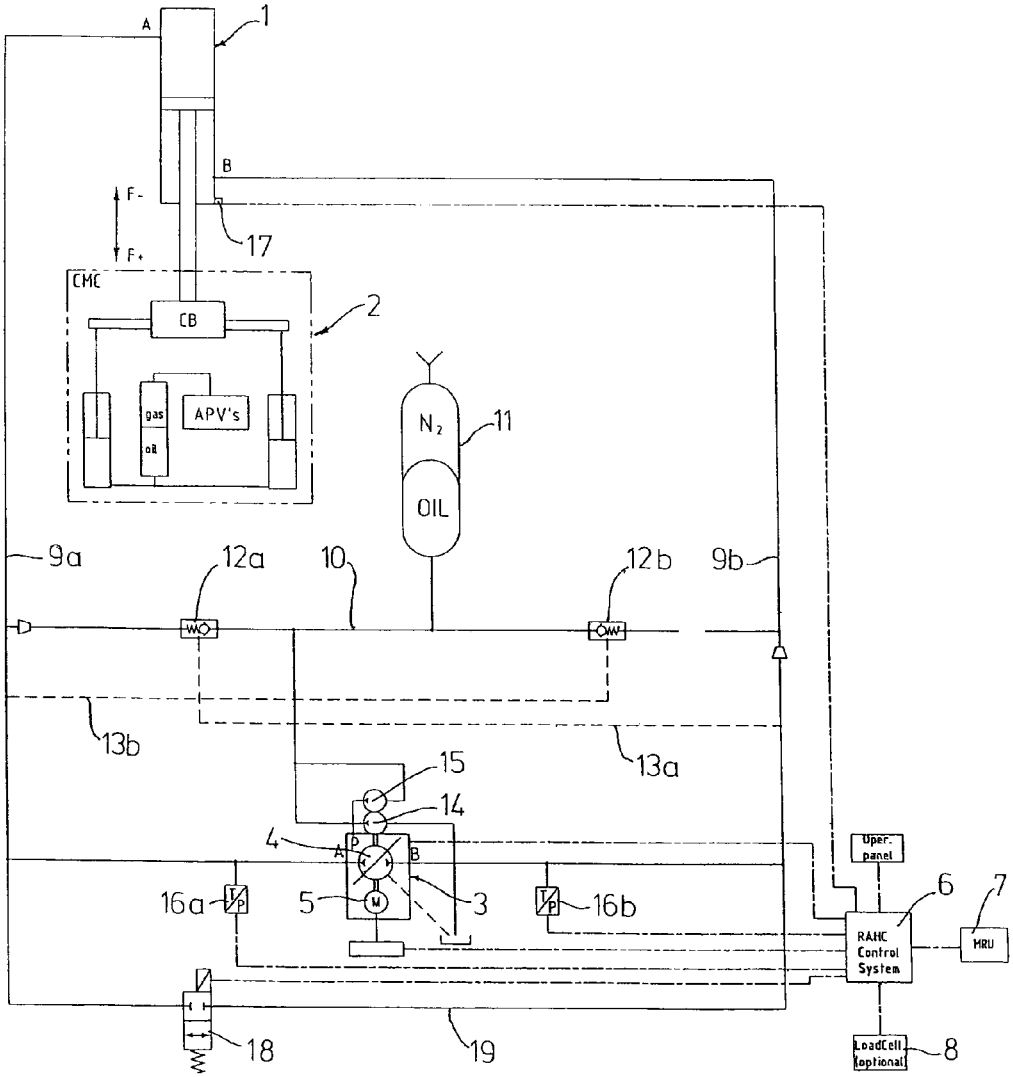

| | | | | |
|---|---|---|---|---|
| 3,948,486 | A | 4/1976 | Jourdan et al. | |
| 4,049,239 | A * | 9/1977 | Howell | 166/355 |
| 4,121,806 | A | 10/1978 | Iato et al. | |
| 4,268,013 | A * | 5/1981 | Khan | 254/392 |
| 4,382,361 | A | 5/1983 | Blanchet | |
| 4,545,437 | A * | 10/1985 | Denison | 166/345 |
| 4,557,332 | A * | 12/1985 | Denison et al. | 166/345 |
| 4,594,853 | A * | 6/1986 | Raichlen et al. | 60/502 |
| 4,616,707 | A * | 10/1986 | Langner | 166/345 |
| 4,617,998 | A * | 10/1986 | Langner | 166/345 |
| 4,962,817 | A | 10/1990 | Jones et al. | |
| 5,846,028 | A * | 12/1998 | Thory | 405/195.1 |
| 6,325,159 | B1 * | 12/2001 | Peterman et al. | 175/7 |
| 6,718,899 | B2 * | 4/2004 | Pollack | 114/230.1 |
| 6,863,507 | B1 * | 3/2005 | Schaeffer et al. | 417/364 |
| 6,887,045 | B2 * | 5/2005 | Schaeffer | 417/225 |
| 7,231,981 | B2 * | 6/2007 | Moe et al. | 166/355 |
| 7,264,058 | B2 * | 9/2007 | Fossli | 166/367 |
| 7,497,266 | B2 * | 3/2009 | Fossli | 166/358 |
| 7,581,901 | B2 * | 9/2009 | Dick | 405/76 |
| 7,909,536 | B2 * | 3/2011 | Dick | 405/76 |
| 2002/0084077 | A1 * | 7/2002 | Finn et al. | 166/354 |
| 2003/0113212 | A1 * | 6/2003 | Schaeffer | 417/225 |
| 2003/0121255 | A1 * | 7/2003 | Dick | 60/398 |
| 2005/0123358 | A1 * | 6/2005 | Blakseth et al. | 405/224.2 |
| 2008/0251258 | A1 * | 10/2008 | Bamford | 166/355 |
| 2009/0133881 | A1 * | 5/2009 | Roodenburg et al. | 166/355 |

FOREIGN PATENT DOCUMENTS

| | | |
|---|---|---|
| WO | WO 01/77000 A | 10/2001 |

* cited by examiner

SYSTEM FOR ACTIVE HEAVE COMPENSATION AND USE THEREOF

This application is a 371 of PCT/NO2007/000190 filed on May 31, 2007, published on Dec. 6, 2007 under publication number WO 2007/139394 A which claims priority benefits from Norwegian Patent Application No. 2006 2521 filed Jun. 1, 2006, the disclosure of which is incorporated herein by reference.

The present invention relates to a system for active heave compensation of a device in off shore arrangement, particularly on board a floating structure, comprising at least one double-acting hydraulic cylinder which is connected to the device which is to be heave compensated, a hydraulic power unit for providing hydraulic pressure fluid to the hydraulic cylinder, a control unit which regulates the supply conditions of the pressure fluid to be currently active side of the hydraulic cylinder, the hydraulic fluid concurrently being permitted to leave the passive side of the hydraulic cylinder, where in the hydraulic power unit comprises a pump unit which via respective conduits are connected to the two sides of the hydraulic cylinder for forming their there with a substantially closed hydraulic system, where in hydraulic fluid delivered by the pump unit to the conduit to the active cylinder side is drawn from the conduit to the passive cylinder side, the control unit regulating the output of the pump.

The system according to the invention is primarily intended as a supplement to a passive heave compensating system for use in drilling hydro carbon wells off shore or interventions in such wells. When drilling, landing equipment on the sea floor, or in other down hole operations from a floating drilling vessel or handling vessel, it is desirable that the drill string or wire is behaving as stabile as possible with respect to the sea floor, independent of the movements of the vessel due to the influence of waves, tide etc. An active heave compensating system in combination with a passive compensating system will increase the efficiency of the vessel, so that operations on the sea floor or down hole may be conduited without being disturbed by wave movements or other influence on the vessel. This will prevent damage to equipment and well formations and, further more, it will be possible to operate under more difficult weather conditions than would other wise be possible.

Active heave compensating systems or drill strings are all ready known. The most common systems are based on active double-acting cylinders of the three-chamber type or cylinders having a double-ended piston rod, e.g. as shown in GB-A-2053127. These are preferably arranged together with a passive compensating system for the crown block of drilling derrick, often called a CMC system (Crown-block Motion Compensation). A CMC system consists of passive compensating cylinders and accumulators coupled to a pressure controlled gas source, such as a compressor, and adjust the necessary tensile force. The three-chambered cylinder is a double-acting cylinder designed such that it has approximately the same acting area and displaced in both directions of movement of the cylinder rod. This permits simpler control and approximate volumetric balance at passive CMC compensation when the active system is not in operation.

The hydraulic system usually consists of a high pressure hydraulic power unit placed at the level of the drill floor. The three-chambered double-acting cylinder is usually placed in the top of the drilling derrick and is mechanically coupled to the passively compensated crown block. Typical capacity is plus/minus 25 mT, and this force is sufficient to overcome mechanical friction and hydraulic resistance in the passive system. The cylinder is controlled by a servo valve mounted on a proportional valve block placed on the cylinder.

The control of the active heave compensation system is based on an acceleration sensor, a so-called "Motion Reference Unit" (MRU), and cylinder position measurement which give input to a computer which sends signals to the servo valve, which in turn regulates the power and movements of the cylinder via the proportional valve block. In some systems the control may also be based on input from pressure transmitters in the hydraulic circuit and from load cells and a lifting yoke, a lifting sheave block or a dead anchor.

A disadvantage of the existing systems is that they require advanced proportional servo valve control and strong hydraulic power units having a large tank volume. The systems also require much space and power since a high pressure loss is generated over the various elements and the long supply pipes between the power unit at drill deck level and the cylinder in the top of the drilling derrick.

The commonly used three-chamber cylinders are expensive, heavy, complicated and require high pressures. Further more, they are vulnerable to internal leakages since they have three sealing interfaces. Besides, three-chamber cylinders do not have exactly the same active area and displaced volume in both directions of movement. This may give rise to a jerking, uncontrolled face displaced active compensation at the restart following passive operation, and from time to time also during regular operation caused by an imbalance in the volumetric relationship.

In other known systems using a cylinder with a double-ended piston rod the cylinder requires much space height wise due to the extending passive part of the piston rod.

The drawback mentioned above necessitates much maintenance work. The location of the various parts of the system makes replacements and service more difficult, particularly during implement weather conditions when the need for the active systems is at its largest.

The purpose of the present invention is therefore to avoid, or at least to reduce the drawbacks of the prior art. This is obtained according to the invention by a system of the type mentioned by way of introduction, which is characterized in the hydraulic system further comprises means which compensate for a volumetric difference between the to sides of the hydraulic cylinders, said means preferably being constructed such that the two conduits from the pump unit are connected to a source for hydraulic fluid in order to receive fluid from, or deliver fluid to, the passive cylinder side where this is necessary in order to maintain fluid balance between the suction side and discharged side of the pump unit.

In this way the hydraulic power unit may be made less costly, smaller and with a minimum tank volume, such that in many cases it will be possible to place it at the same level at the hydraulic cylinder and thereby avoid the long connection conduits. Further more, the jerking starting movement of the three-chambered cylinders may be eliminated and the use of simpler cylinder types may be made possible.

Thus, according to a preferred embodiment of the invention, it is suggested to use a hydraulic cylinder in the form of a common-acting cylinder, e.g. a differential cylinder. In this case the piston area and volume of the passive cylinder side will be much smaller than on the active side. In order to accommodate the apparent imbalance this will cause in a closed system, the two conduits from the pump unit are connected to an accumulator for hydraulic fluid for receiving fluid from, or delivering fluid to, the passive cylinder side where this is necessary in order to maintain the fluid balance between the suction side and the discharged side of the pump unit. Where as can be arranged between the conduits and the accumulator which act to close the accumulator against the instant cylinder side and open towards the passive cylinder side. These valves may be chosen from the group of pressure controlled check valves, electrically controlled valves, pneumatically controlled valves and pressure controlled over center valves.

The pump unit may comprise a step less variable positive displacement pump, or two variable positive displacement pumps which pumps to one side each of the hydraulic cylinder, possibly with indifferent capacity. It is also possible to use constant positive displacement pumps driven by rotational speed controlled power units, preferably frequency controlled alternating current motors.

In order for the system according to the invention to operate in shorter periods with higher compensating velocity the capacity of the hydraulic power unit would aloud, the pump unit may according to the invention be connected to a high pressure accumulator system for extra supply of hydraulic fluid to the hydraulic cylinder. This accumulator system may be discharged during passive operation of the system through external force influence, such as from a connected passive compensation system. Similarly, it is possible to charge the high pressure accumulator system by means of the heave compensation system's own pump unit in situations where it has spear capacity. Further more, it will be possible to replace the pump unit by a hydraulic transformer unit, which can act both as pump and motor, thereby permitting recovery and storage of energy bypassive and preferably also active operation of the system.

In situations where the active heave compensation system according to the invention is not used actively, e.g. because the connected passive compensation system is sufficient, the piston of the hydraulics cylinder will never the less move in step with the heave movements of the vessel. This causes hydraulic oil to be pumped by the cylinder back and forth through the system, and if this does not take place via the pump unit for regenerating energy, a bypass conduit around the pump unit must be present. Such a bypass conduit may also be constituted by the conduits connecting the above-mentioned fluid balancing accumulator to the two piston sides, but in this case steps must be taken for the valves in these conduits to open for the necessary fluid flow to and from the accumulator. However this will be within the normal capabilities of a skilled person.

An additional advantage of the compact form of the system according to the invention is that it may be put together of modules, preferably a first module comprising the pump unit with valves, the control unit and preferably a bypass conduit having a shut off valve and pressure sensors, a second module comprising the accumulator and a third module comprising the hydraulic cylinder.

It will be understood that the system according to the invention may not only be used in addition to a passive heave compensation system for a crown block in a drilling derrick, but that it also will be suitable for heave compensation of a running block mounted drill string, a winch, a crane, and A-frame or a sub-A-frame.

Figure 2:
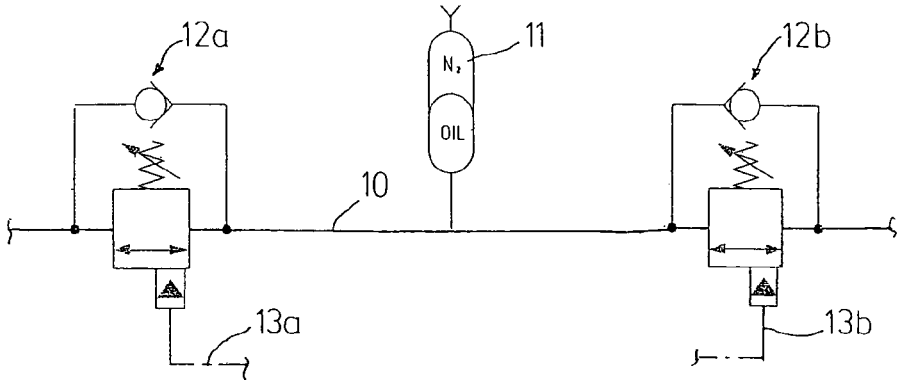
Figure 3:
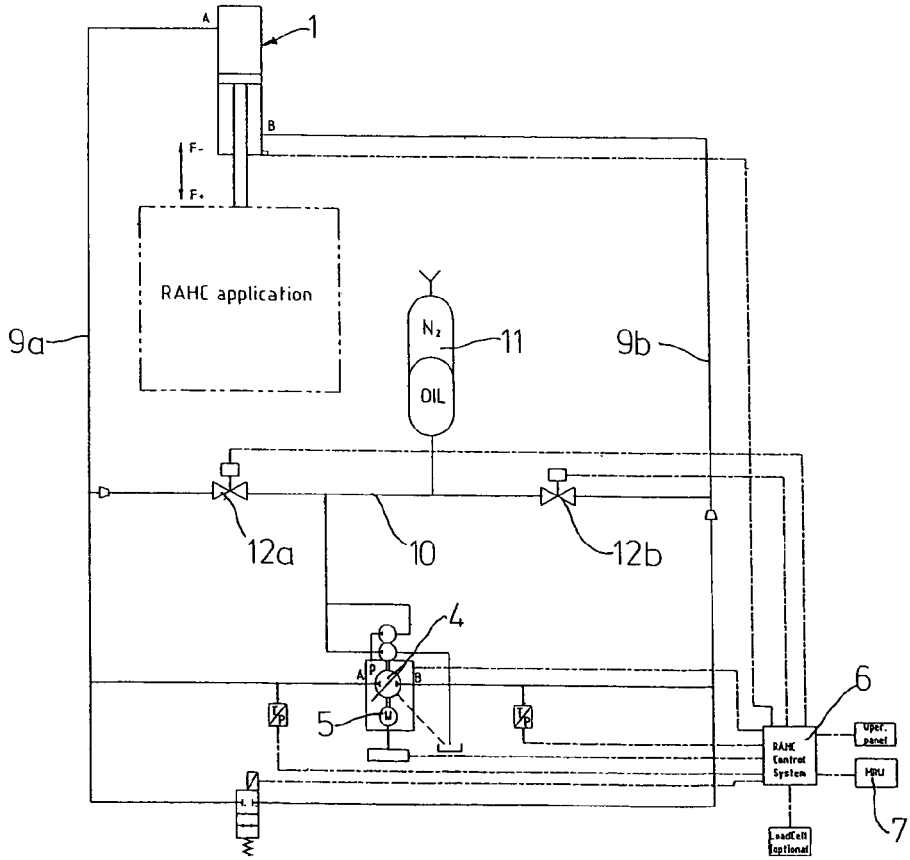
Figure 4:
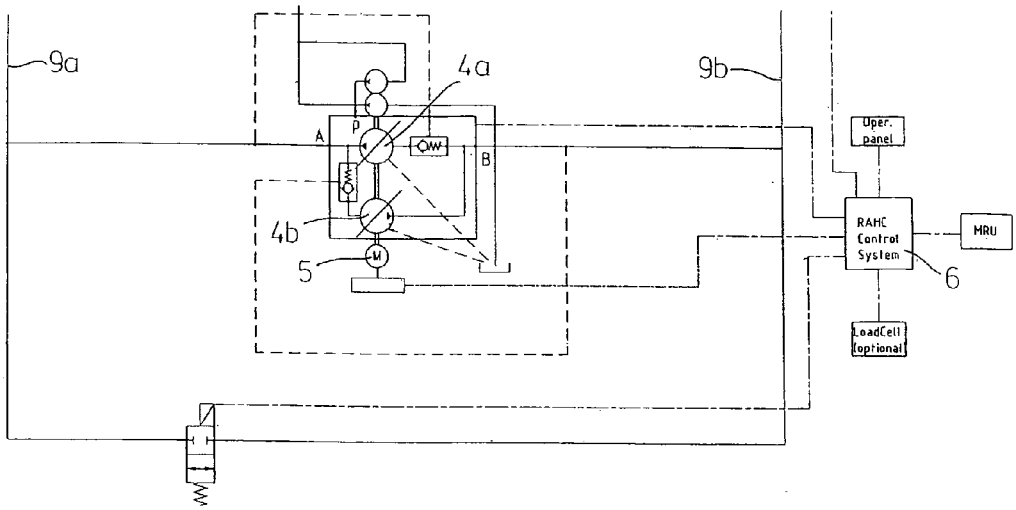
Figure 5:
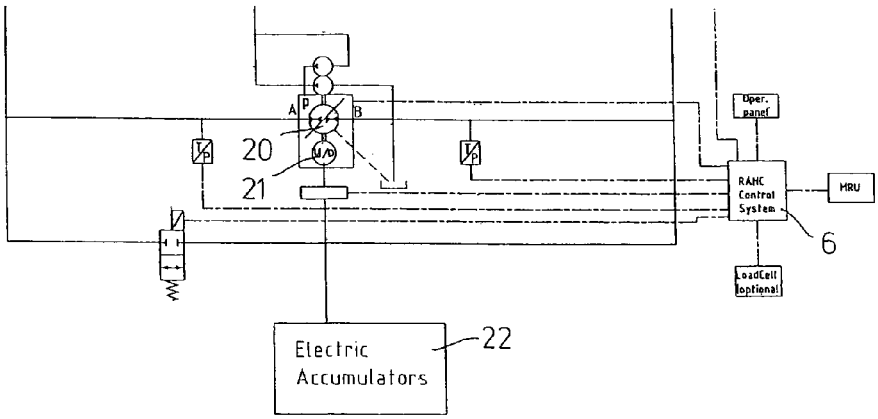
Figure 6:
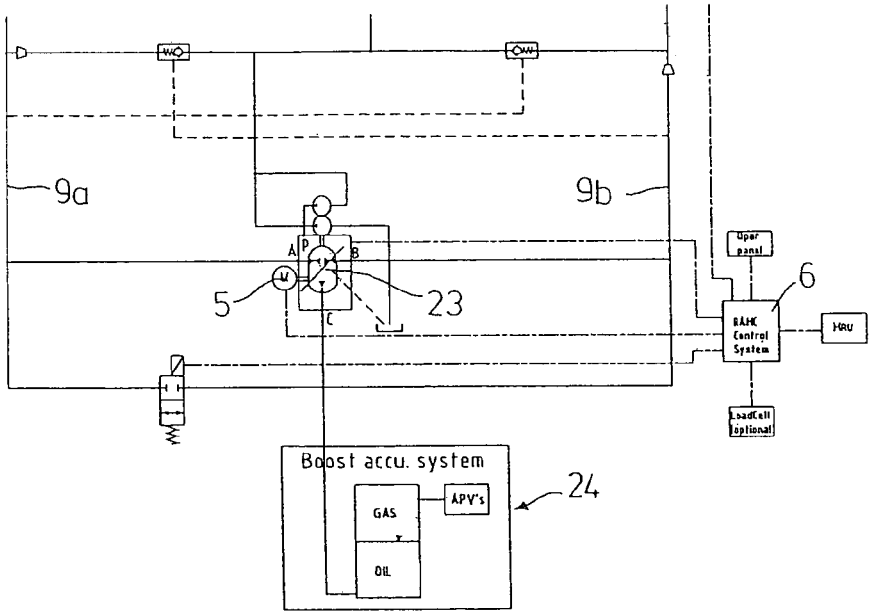
Figure 7:
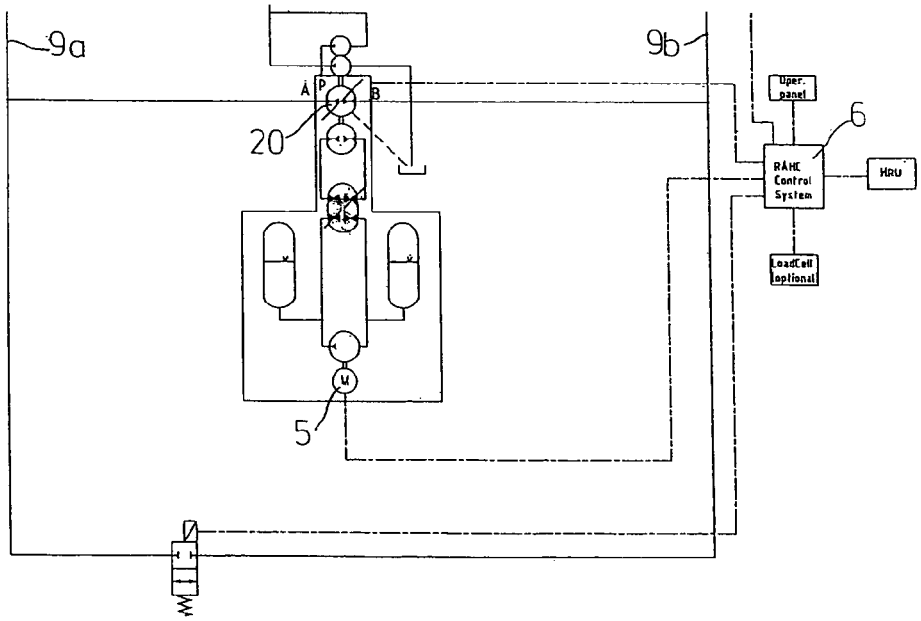
Figure 8:
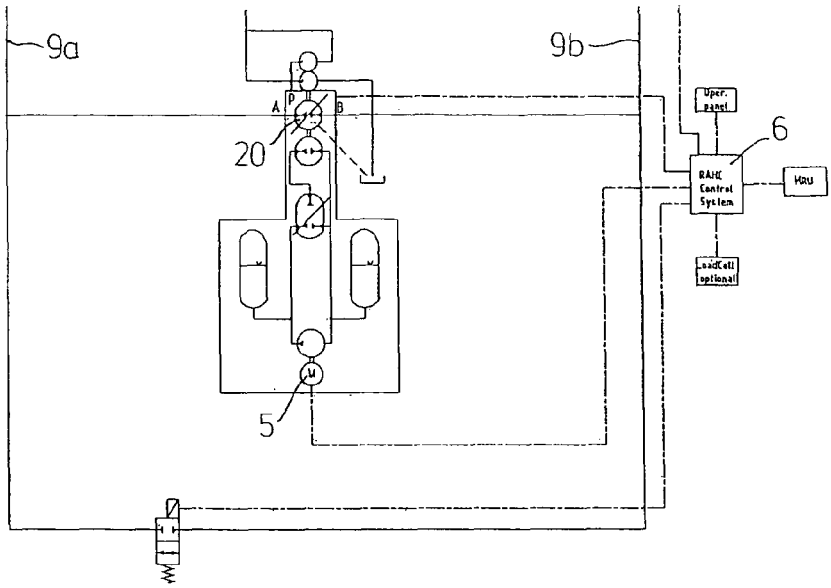
Figure 9:
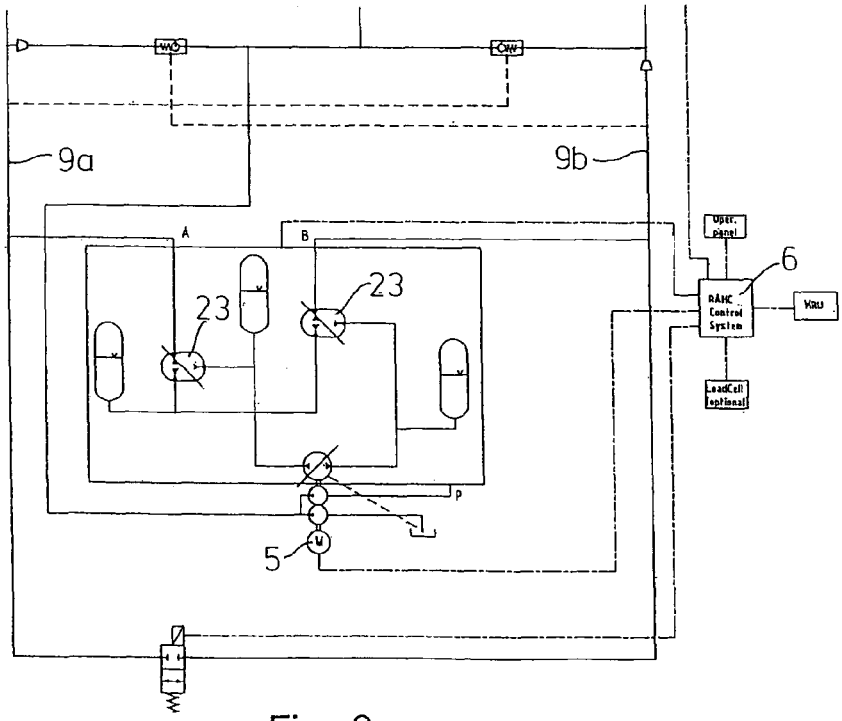
Figure 10:
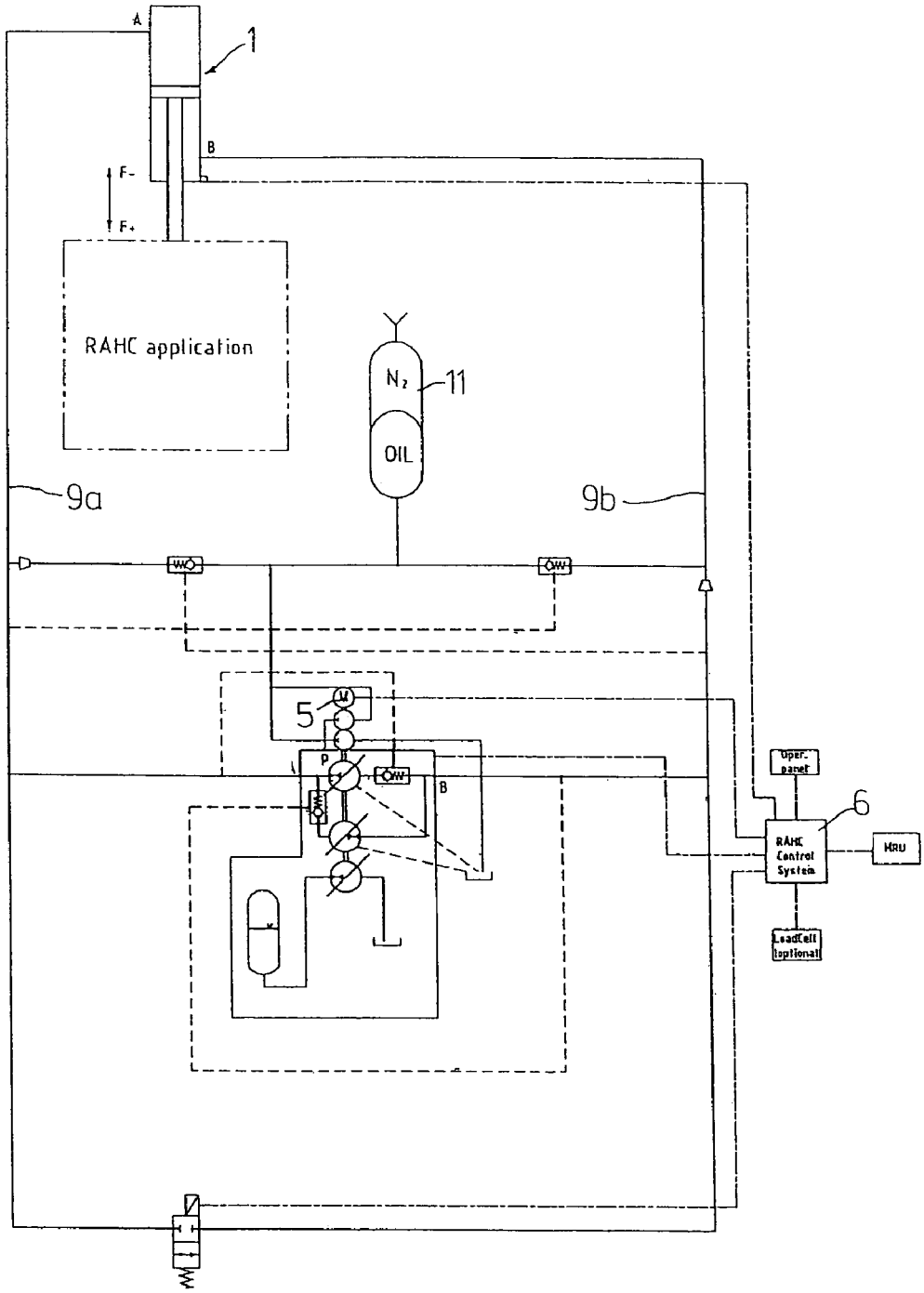

Further advantage features of the invention will be apparent from the deep ended claims and from the following description of exemplifying embodiments of the invention in connection with the appended drawings, where FIG. 1 is a schematic flow diagram for a first embodiment of the system according to the invention, FIG. 2 is a schematic flow diagram for a detail of a second embodiment of the system according to the invention, FIG. 3 is a schematic flow diagram for a third embodiment of the system according to the invention, FIG. 4 is a partial schematic flow diagram for a fourth embodiment of the system according to the invention, FIG. 5 is a partial schematic flow diagram for a fifth embodiment of the system according to the invention, FIG. 6 is a partial schematic flow diagram for a sixth embodiment of the system according to the invention, FIG. 7 is a partial schematic flow diagram for a seventh embodiment of the system according to the invention, FIG. 8 is a partial schematic flow diagram for an eight embodiment of the system according to the invention, FIG. 9 is a partial schematic flow diagram for a ninth embodiment of the system according to the invention, FIG. 10 is a partial schematic flow diagram for a tenth embodiment of the system according to the invention, FIG. 11-15 illustrate schematically different use possibilities for the system according to the invention.

The exemplifying embodiment illustrated in FIG. 1 comprises a double-acting hydraulic cylinder 1 which is connected to a device 2 which is to be heave compensated, here shown in the form of a passive compensation system CMC for the crown block CB in e.g. a drilling derrick (not shown). The double-acting hydraulic cylinder 1 may be a differential cylinder, i.e. in area on the piston rod side B is equal to the piston area on the plus side A. More over, ratios between the two sides are possible, provided that the buckling strength of the piston rod is sufficient for the current use.

The hydraulic cylinder is provided with hydraulic pressure fluid from a fluid power unit 3, the unit containing a pump 4 having variable positive displacement and is driven by a motor 5. The hydraulic power unit 3 is controlled by a control system 6, which receives input from an acceleration sensor or the like 7, also called "Motion Reference Unit" (MRU). The control system may also receive input from a load cell 8 in the device 2 to be heave compensated.

The pump 4 is connected to the two sides A, B of the hydraulic cylinder 1 by means of respective conduits 9*a*, 9*b*. The conduits 9*a*, 9*b* are connected to each other by means of a conduit 10, which is connected to a low pressure accumulator 11. On either side of the accumulator 11 the conduit 10 is provided with pilot operated (pressure controlled) check valves 12*a*, 12*b*, which in normal operating mood permit fluid flow from the accumulator 11 to the respective conduits 9*a*, 9*b*. The check valves 12*a*, 12 *b* are provided with their own pilot pressure conduit 13*a*, 13*b*, which extend from the opposite conduit 9*b*, 9*a*, respectively. At a certain pressure in the pilot pressure conduit the connected check valve 12*a*, 12*b* is forced open so that it permits flow in both directions.

During operation of the active heave compensation system according to the invention the hydraulic unit 3 with the pump 4 will be the superior pressure source and control unit for the work of the cylinder 1. At positive cylinder movement (F+, rod out) the pump 4 will pump at high pressure through the conduit 9*a* to the side A of the hydraulic cylinder 1. Concurrently, the pump will draw from the side B of the hydraulic cylinder through the conduit 9*b*, but since the displaced volume from the piston rod side B of the cylinder 1 is much less than the volume which has to be provided to the piston side A, the pump 4 concurrently draws fluid from the low pressure accumulator 11 via the check valve 12*b*. When the cylinder 1 is driven in the opposite direction (F− rod in), the pump 4 delivers pressure fluid to the rod side B of the cylinder via the conduit 9*b*. However, concurrently a larger volume is displaced from the piston side A of the cylinder than the pump 4 draws in, and this surplus is supplied to the low pressure accumulator via the conduit 10, and the check valve 12*a*. This is possible because the pressure in the conduit 9*b* has opened the check valve 12*b* via the signal conduit 13*a* for flow in both directions.

Leakage in the system is compensated for by a low pressure pump 14, which serves to maintain the volumetric balance in the system. A high pressure pilot pressure pump 15 provides a stabile pilot pressure to the control block of the variable positive displacement pump 4 in order to facilitate the necessary control response of the pump 4. Pressure transmitters 16*a*, 16*b* are mounted on either side of the pump 4 and send signals to the control system 6. This system is also provided with a signal from a position sensor 17 for the cylinder 1.

When the active heave compensation system according to the invention is inactive because the connected passive system 2 provides sufficient heave compensation, the cylinder 1 will, never the less, be forcibly driven by the movements of the passive system. In this case the pump 4 is disengaged and a bypass valve 18 in a bypass conduit 19 is opened in order to let the fluid flow between the two sides of the cylinder. At a positive cylinder stroke (rod out) the fluid flow will go from the rod side B to the piston side A, fluid concurrently being drawn from the accumulator 11 through the check valve 12*a*. At the opposite cylinder stroke a smaller pressure increase in the conduit system 9*a*, 9*b* will cause the check valves 12*a*, 12*b* to open and permit surplus fluid from the piston side A to flow to the accumulator. As an alternative to the bypass conduit 19 one may use the low pressure conduit 10 as a bypass conduit, but in this case one must take precautions for the check valves 12*a*, 12*b* to open as necessary. This may be done by installing a suitable valve between the pressure signal conduits 13*a*, 13*b*, e.g. an electrically operated double bypass valve, such that the valve 12*a* is connected to the conduit 13*b* and the valve 12*b* is connected to the conduit 13*a* when the system is driven in inactive mood. In this case the check valve and the corresponding part of the valve 10 up to the accumulator 11 must be dimensioned for the entire fluid flow from the piston side A of the hydraulic cylinder.

As an example of the dimensioning of the system, the hydraulic cylinder 1 may have a stroke of 7.6 metres, in operating pressure 235 bar, a maximum force of 250 kN, and a stroke velocity of 1 m/sec. The low pressure accumulator may have a volume of 200 litres and function at a pressure of 4-8 bar. The system may also be provided with safety valves, both on the high pressure side and low pressure side, and a filter unit and a cooling system (not shown in FIG. 1).

FIG. 2 shows an alternative embodiment of the check valves 12*a* and 12*b*. In this case the pressure signal via conduits 13*a* and 13*b* does not act directly on the check valve, but opens a bypass valve around the check valve.

FIG. 3 shows a further variant where the check valves 12*a*, 12*b* are replaced by electrically controlled logical on/off valves.

An alternative embodiment of the hydraulic power unit 3 is shown in FIG. 4. Here the proportional over centre pump 4 is replaced by two variable positive displacement pumps 4*a* and 4*b* pumping to sides A and side B, respectively. These pumps may have different flow and pressure ratings. They may also be replaced by constant positive displacement pumps being driven by frequency controlled alternating current motors (not shown).

In a further embodiment of the invention illustrated in FIG. 5 the proportional over centre pump 4 is replaced by a servo pump 20 which can act as a combined pump and motor in order for it to be driven by an electric motor or to drive a generator 21. By passive operation of the system, the pump 20 may be used as a motor for driving the generator 21 and for generating electric power which may be stored, e.g. in batteries 22. This energy may later be used when the system is operated actively.

FIG. 6 shows an embodiment where the proportional over centre pump is replaced by a hydraulic transformer 23 which can act as a combined motor and pump for pressurizing a hydraulic/pneumatic accumulator 24 during passive compensator operation. The stored hydraulic energy can be applied for shorter periods during active compensation as a reinforcement in order to nearly double the stroke capacity of the hydraulic cylinder.

FIGS. 7-10 show further examples of how the hydraulic transformer is used for storing hydraulic energy in accumulators. This high pressure regeneration of energy has led to the process according to invention often being referred to "Regenerative Active Heave Compensation" (RAHC).

Figure 11:
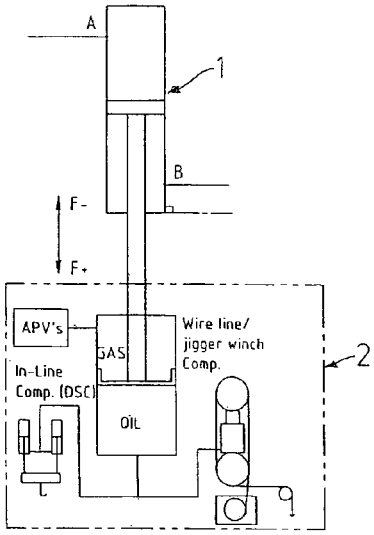
Figure 12:
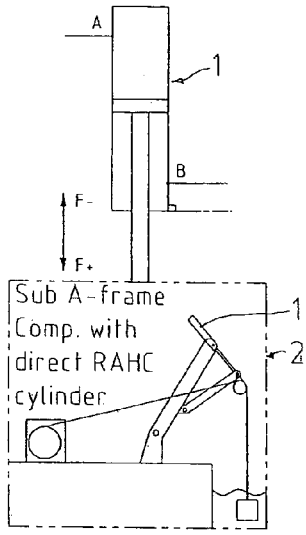
Figure 13:
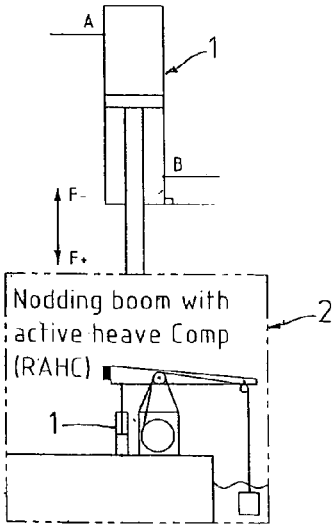
Figure 14:
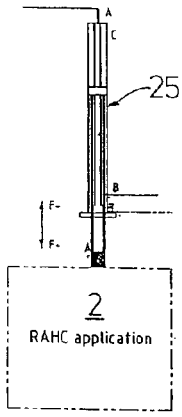
Figure 15:
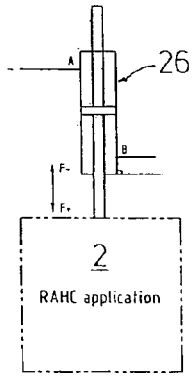

It will be understood that the system according to the invention also can be used at an advantage for other services than active heave compensation of the crown block in a drilling derrick. Examples of such alternative uses are illustrated in FIGS. 11-13. Thus, FIG. 11 shows to different uses, i.e. heave compensation of a running block mounted drill string (DSC) and heave compensation of a jigger winch. FIG. 12 illustrates heave compensation of a sub-A-frame, while FIG. 13 shows the system in relation to a nodding boom crane. FIGS. 14 and 15 indicate that the system according to the invention also may be used with hydraulic cylinders of the three-chamber type 25 and cylinder 26 having a through-going piston rod.

It will be understood that the invention is not limited to the exemplifying embodiments described above, but may be varied and modified by a skilled person within the scope of the following claims. It will also be understood that the invention has solved many of the problems typical of the prior art. Thus, the invention has made possible substantial reduction, e.g. in the area 25-40% with respect to weight, price and power consumption.

The invention claimed is:

1. A system for active heave compensation of a device in an offshore arrangement, particularly on board a floating structure, comprising at least one double-acting, single piston rod hydraulic cylinder which is connected to the device which is to be heave compensated, the piston rod side of the cylinder displacing less volume than the opposite, piston side of the cylinder, a hydraulic power unit for providing hydraulic high-pressure fluid to the currently active side of the hydraulic cylinder, a control unit which regulates the supply conditions of the high-pressure fluid to the currently active side of the hydraulic cylinder, low-pressure hydraulic fluid concurrently being permitted to leave the currently passive side of the hydraulic cylinder, wherein the hydraulic power unit comprises a pump unit which via respective conduits are connected to the two sides of the hydraulic cylinder for forming therewith a substantially closed hydraulic system, wherein hydraulic fluid delivered by the pump unit to the conduit to the currently active high-pressure cylinder side is taken at least partly from the conduit to the currently low-pressure passive cylinder side, the control unit regulating the output of the pump, and wherein the hydraulic system further comprises means which compensate for the displacement volume difference between the two sides of the hydraulic cylinder, said means comprising an accumulator for low-pressure hydraulic fluid and associated piping constructed such that the two conduits from the pump unit are connected through pressure or electric actuated valves to the accumulator for low-pressure hydraulic fluid in order for the accumulator to receive fluid from, or deliver fluid to, the currently low-pressure passive cylinder side as necessary in order to maintain fluid balance between the suction side and discharge side of the pump unit, said valves being arranged to close the accumulator against the currently active cylinder side and open the accumulator towards the currently passive cylinder side.

2. A system according to claim 1, wherein said valves are chosen from the group of pressure controlled check valves, electrically controlled valves, pneumatically controlled valves, and pressure controlled overcentre valves.

3. A system according to claim 1, wherein the pump unit comprises a continuously variable positive displacement pump.

4. A system according to claim 1, wherein the pump unit comprises two variable positive displacement pumps pumping to either side of the hydraulic cylinder.

5. A system according to claim 1, wherein the pump unit comprises constant positive displacement pumps which pump to either side of the hydraulic cylinder and are driven by rotational speed controlled power units.

6. A system according to claim 1, wherein the hydraulic cylinder is a differential cylinder.

7. A system according to claim 1, wherein the pump unit comprises a low pressure pump feeding the accumulator in order to compensate for any leakage from the system.

8. A system according to claim 3, wherein the pump unit comprises the control pressure pump which supplies the control block of the positive displacement pump with a stable pressure.

9. A system according to claim 1, wherein the pump unit is connected to a high pressure accumulator system for extra supply of hydraulic fluid to the hydraulic cylinder during need for higher compensation velocity.

10. The system according to claim 9, wherein the high pressure accumulator system is charged by passive operation of the system during external force influence, such as from a connected passive compensation system.

11. A system according to claim 1, wherein the system comprises a bypass conduit provided with a shut-off valve, said bypass conduit being arranged between the conduits to the hydraulic cylinder for opening when the system operates in passive mode.

12. A system according to claim 1, wherein the system is assembled from modules, with a first module comprising the pump unit with valves and the control unit, a second module comprising the accumulator, and a third module comprising the hydraulic cylinder.

13. A system according to claim 1, wherein the pump unit is replaced by a hydraulic transformer unit, said transformer unit being connected to a device for storing energy recovered during passive and preferably also active operation of the system.

14. The use of a system according to claim 1 as an addition to a passive heave compensation system for a crown block in a drilling derrick, or for heave compensation of a running block mounted drill string, a winch, a crane, an A-frame, or a sub-A-frame.

* * * * *